United States Patent [19]

Robb

[11] Patent Number: 4,944,633

[45] Date of Patent: Jul. 31, 1990

[54] BOAT SUPPORT MEANS

[75] Inventor: Frank B. Robb, Willoughby, Ohio

[73] Assignee: Jos. Dyson & Sons, Inc., Painesville, Ohio

[21] Appl. No.: 335,707

[22] Filed: Apr. 10, 1989

Related U.S. Application Data

[63] Continuation-in-part of Ser. No. 215,234, Jul. 5, 1988, abandoned.

[51] Int. Cl.[5] ..... B63C 1/08; B63C 15/00

[52] U.S. Cl. ..... 405/3; 405/7; 254/112; 254/DIG. 4

[58] Field of Search ..... 405/3, 4, 7; 254/112, 254/102, 94, DIG. 4

[56] References Cited

U.S. PATENT DOCUMENTS

| | | | |
|---|---|---|---|
| 1,483,843 | 2/1924 | Costello | 254/112 |
| 3,139,277 | 6/1964 | Mears | 405/7 X |
| 3,586,285 | 6/1971 | Modzelewski | 405/7 X |
| 4,155,667 | 5/1979 | Ebsen | 405/7 |
| 4,468,150 | 8/1984 | Price | 405/7 |
| 4,756,642 | 6/1988 | Quinn et al. | 405/7 |
| 4,759,660 | 7/1988 | Corbett | 405/7 |

FOREIGN PATENT DOCUMENTS

| | | | |
|---|---|---|---|
| 2534351 | 4/1984 | France | 405/3 |
| 0211993 | 12/1983 | Japan | 405/7 |
| 2086810 | 5/1982 | United Kingdom | 405/7 |
| 2092529 | 8/1982 | United Kingdom | 405/7 |

*Primary Examiner*—Dennis L. Taylor
*Assistant Examiner*—J. Russell McBee
*Attorney, Agent, or Firm*—Frank B. Robb

[57] ABSTRACT

Boat cradle and storage construction including a plurality of substantially identical support units each availing of a central column comprising a support element and brace parts connected to the column and a base member of chevron shape with an adjustable ram in the column extending upwardly, and a pad at its end to engage the bottom of a boat or the like, the arrangement of the column and brace parts being such as to reduce space required for storage of the units when not in use and yet the base member shape provides stability, the arrangement of the brace parts being important from the standpoint of the overall assembly.

14 Claims, 3 Drawing Sheets

FIG.1
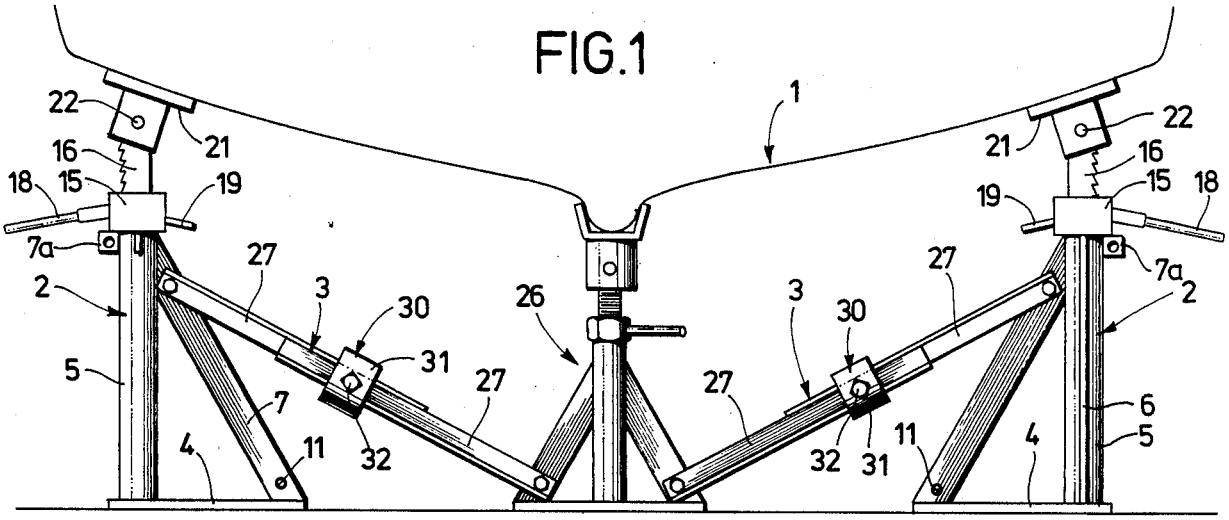
FIG.2
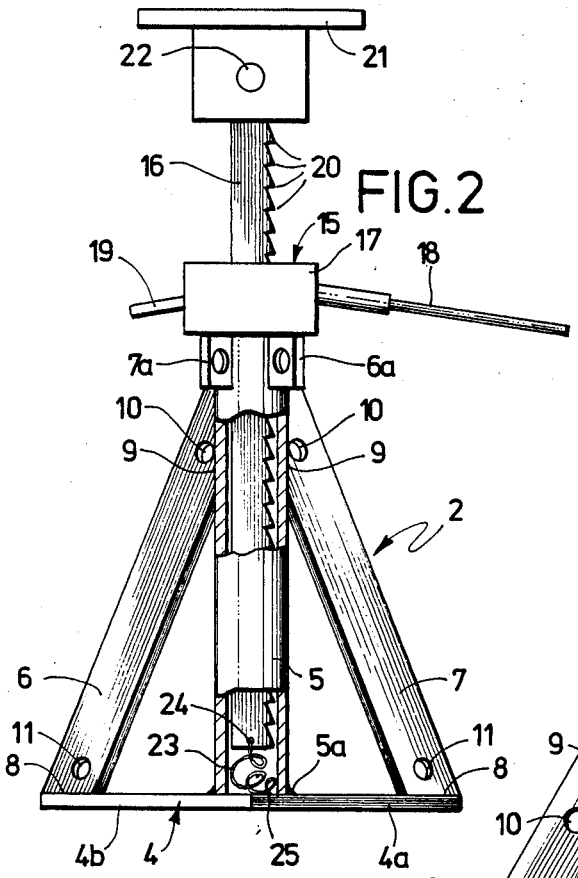
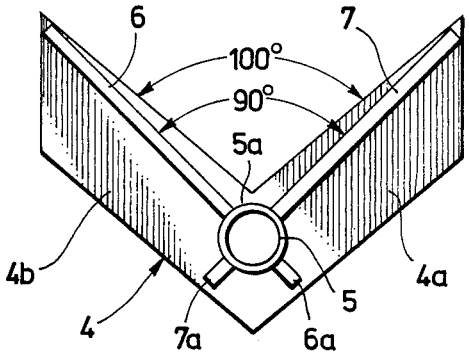
FIG.4
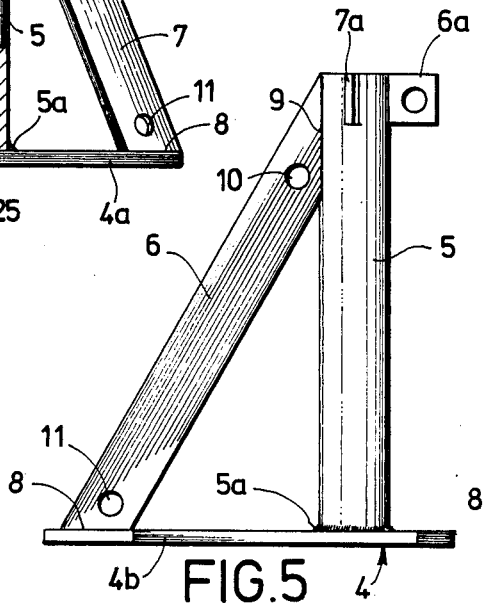
FIG.5
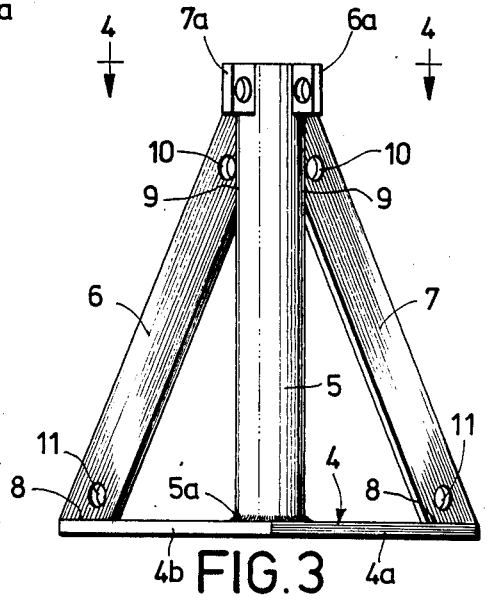
FIG.3

BOAT SUPPORT MEANS

This application is a continuation-in-part of application Ser. No. 07/215,234, filed Jul. 5, 1988 now abandoned, for "Cradle and Storage Support Means".

BACKGROUND OF THE DISCLOSURE

This invention relates to support means for boats, or similar objects which are desirably positioned at various locations and supported above the ground or other place of storage.

Further, the contemplation hereof is that some substantial improvements are provided over the co-pending application of which this is a continuation-in-part, in that while there are certain common elements and arrangement of parts such as the brace parts of the support means which comprise support units, being located so as to make for assembly of a number of the units into a coordinated whole for supporting a boat or similar object, and yet definite advantages are derived from the construction hereof in relating to the problem of storage of units when they are not in use, which is an important factor in the businesses in which such units are associated and in which they are used.

In the instant case the support units are somewhat similar to the prior disclosed unit, but involve a base of a quite different shape and an arrangement of the respective upright parts so as to more economically provide a device which will find its use in the marketplace substantially enhanced because of the lesser cost thereof.

In the prior application, and a co-pending application Ser. No. 07/027,899, filed Mar. 19, 1987 now U.S. Pat. No. 4,756,642, related boat storage shipping system and support means are disclosed which are found in the same field of commerce as the instant invention, there being however several notable differences as will be understood from the description which is subsequently to be set forth, involving the ability to use the support units in related arrangements and store the same in the manner to take advantage of space and also the reduction in material required to manufacture the said same items all of which will be apparent hereinafter.

In the co-pending application Ser. No. 07/027,899, several patens were cited including that of Mears, 3,139,277, Ebsen, 4,155,667, and Price 4,468,150, all directed to related uses such as the instant invention and its merit, including tension elements which are arranged in different ways however and include substantially different forms of parts which are interconnected so as to provide a better arrangement and simpler concept than that previously disclosed and thus the said patents referred to are not really suggestive of the connectable positions provided by the instant application.

The U.S.S.R. patent 1,082,680 is not related to the instant concept nor in fact to those of the references set forth above.

While the overall concept of support units has been disclosed in the several applications referred to and is of course known in the art, there are certain aspects which can be improved upon and which have been improved upon by the instant disclosure as well as those which are realted hereto by common elements, the instant invention however being constructed differently from any of the prior art as far as is known and now to be described in general.

It will be apparent as the inventions are viewed along with one another that differences in shapes of parts and interconnecting aspects are improvements over what has been disclosed in the prior referred to application.

GENERAL DESCRIPTION OF THE INVENTION

The invention is shown with the various elements thereof involving a somewhat similar disclosure to that of the application of which this is a continuation-in-part, but the instant invention discloses a novel base which is chevron-shaped, and a positioning of the supporting parts thereon and in connection therewith such that storage of the respective units in completed form is much more easily effected. In fact by reason of the construction involving a vertical column and a pair of brace parts, in contrast to the usual concept which requires more brace parts, construction such as here disclosed is less complicated yet stability is provided and paramount in the complete unit.

That the brace parts of the support unit are arranged at right angles to one another has been disclosed in the application Ser. No. 07/215,234, now abandoned but it is improved on herein as it affects the overall arrangement of parts and of support units when they are in working position and they have been constructed to provide support under the various conditions which prevail in the yards and like storage areas.

Further, it is contemplated that a different type of adjustable mechanism of the support units be provided enabling more rapid adjustment and simpler positioning and removal where that is of importance.

In the final analysis the fact that substantially less material is involved in the construction of the support units is obviously valuable as it makes the cost of the units substantially less in any event.

The fact that the support units are connectible by tension parts of novel construction which have been basically disclosed heretofore in the co-pending application, Ser. No. 07/027,899, now U.S. Pat. No. 4,756,642 it is nevertheless a part of the instant invention and involves the use of the support units of this disclosure in a simpler and more effective arrangement.

DETAILED DESCRIPTION OF THE DRAWING

The invention hereof is shown in a number of different aspects and involving the particular shapes desired and effective for the purposes hereof, and particularly disclosed as to their relationship in the drawings wherein:

FIG. 1 is a somewhat schematic view showing the support units in position beneath a boat and in their arrangement with relation to one another.

FIG. 2 is a partly sectional side elevation of one of the support units.

FIG. 3 is a similar view to FIG. 2, but fragmentary in nature in order to more particularly illustrate other aspects of the concept.

FIG. 4 is a view taken about on the line 4—4 of FIG. 3 looking in the direction of the arrows to more clearly illustrate the arrangement of the brace parts and column connected thereto.

FIG. 5 is a view from the side of FIG. 4 and taken about on the line 5—5 of FIG. 4 so as to more particularly illustrate the arrangement of the brace parts and column for support.

DETAILED DESCRIPTION OF THE INVENTION

Figure 6:
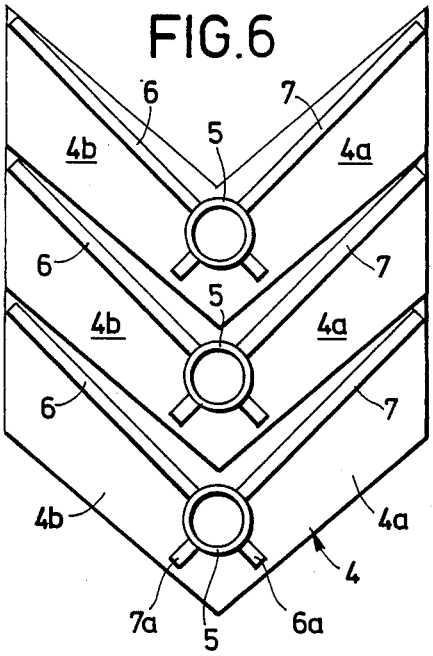
FIG. 6 is a fragmentary view, illustrating the nesting capabilities of the bases and parts hereof.

Turning now to a specific description of the concept, there is disclosed in FIG. 1 the outline of the bottom of a boat generally designated 1, the same having the usual contours or at least contours of one form, for support by support units hereof, which support units are generally designated 2, one being positioned at each opposite side of the lower portion of the boat, additional support units provided fore and aft as may be necessary depending upon the size of the boat.

The support units 2 are connected by a tension unit generally designated 3, more particularly to be described hereinafter.

Each of the support units 2 is formed as will now be described in detail so as to include a base member which in this instance and desirably, is in the form of a chevron having divergently extending arms 4*a* and 4*b* as viewed in FIG. 4, with a central upstanding column 5 of tubular nature for reasons which will appear, securely fastened at 5*a* as by welding to the base 4.

The column 5 is maintained in its vertical position by the provision of brace parts 6 and 7, referring to FIG. 2 and other figures likewise, the parts 6 and 7 being welded at 8 to the base 4 at their lower ends and at their upper ends at 9 to the upper portion of the column 5 near its upper end.

As will be noted, the brace parts 6 and 7 extend from the column 5 as shown in FIG. 4 at right angles and for purposes which will subsequently appear and as has been mentioned to previously.

In any event, the brace parts 6 and 7 are in a different angular relationship than the arms 4*a* and 4*b* of the base 4 as the edges 4*c* and 4*d* are arranged at about a 100 degree angle to provide better stability as is conceived hereby.

It should be noted that in all cases the brace parts 6 and 7 are equipped with suitable bolt openings such as 10 at their upper ends, and 11 at their lower ends for purposes which will also subsequently be referred to.

In addition to the foregoing, the central column is provided at its upper end with certain wing parts designated 6*a* and 7*a* in view of the fact that these extend in alignment with their respective brace parts 6 and 7 and are for use in assemblies which will be disclosed hereinafter. It is also noted that the wings 6*a* and 7*a* are also provided with bolt openings 6*b* and 7*b* in their respective parts.

Turning now to a consideration of FIG. 2 which discloses the hollow nature of the tube 5, it will be seen that there is supported within that tube the ram of a jack unit generally designated 15, the ram being designated 16, the jack unit being controlled in a ratchet box 17 by a lever 18 of and a trip lever 19 availed of to release the ratchet.

It is noted that the ram 16 is provided with a series of teeth 20 along one of the edges thereof so that the ratchet box operating mechanism will raise the ram as needed upon operating lever 19 and carry with it the pad element 21 pivotally connected at 22 at its upper end.

It will be understood that the purpose of this arrangement is to quickly bring the pad 21 into position beneath the boat 1 when the support units 2 are being arranged as desired.

It may be pertinent to note that the ram 16 is prevented from being removed from the tube 5 by the provision of a cable 23 connected at the lower end of the ram at 24 and to the base 4 at 25, because when these units are stored it would be to remove a ram-jack combination which could then be mislaid whereas it is desirable to keep each jack unit in association with its respective support unit.

It is noted that the jack unit generally designated 15 as previously mentioned is removable as a whole normally from the position from within the tubular element 5, but as restrained by the arrangement previously described.

Turning now to a discussion of the manner in which the support units hereof are used and to more particularly describe the tension units which are also novel, it will be seen that in FIG. 1, a central support of different kind designated 26 is disclosed in the form of a jack which is adjustable in any preferred manner to engage the keel of the boat and the support units 2 previously described are connected to that jack 26 by the tension units 3 previously mentioned now to be described in more detail.

Figure 7:
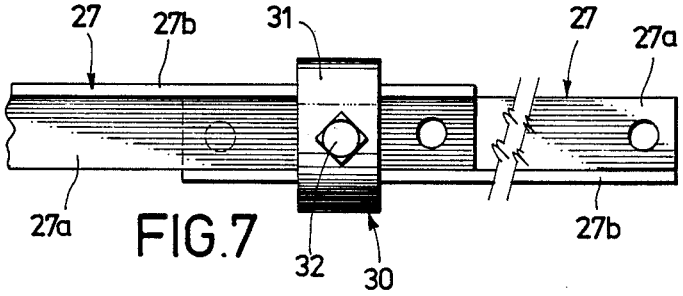
FIG. 7 is a fragmentary view showing the connection of the tension means and the adjustable nature thereof.
Figure 8:
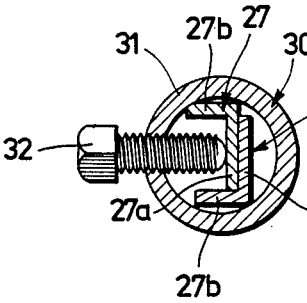
FIG. 8 is a sectional view showing the tension means.

It is apparent that these tension units 3 are adjustable when the disclosures of FIGS. 7 and 8 are referred to, noting that each of the tension members is provided with a body of elongated form designated 27 of identical cross-section comprising an angle having a main portion 27*a* which is about 2" wide, and a flange 27*b* extending at right angles and about 1" wide.

Figure 9:
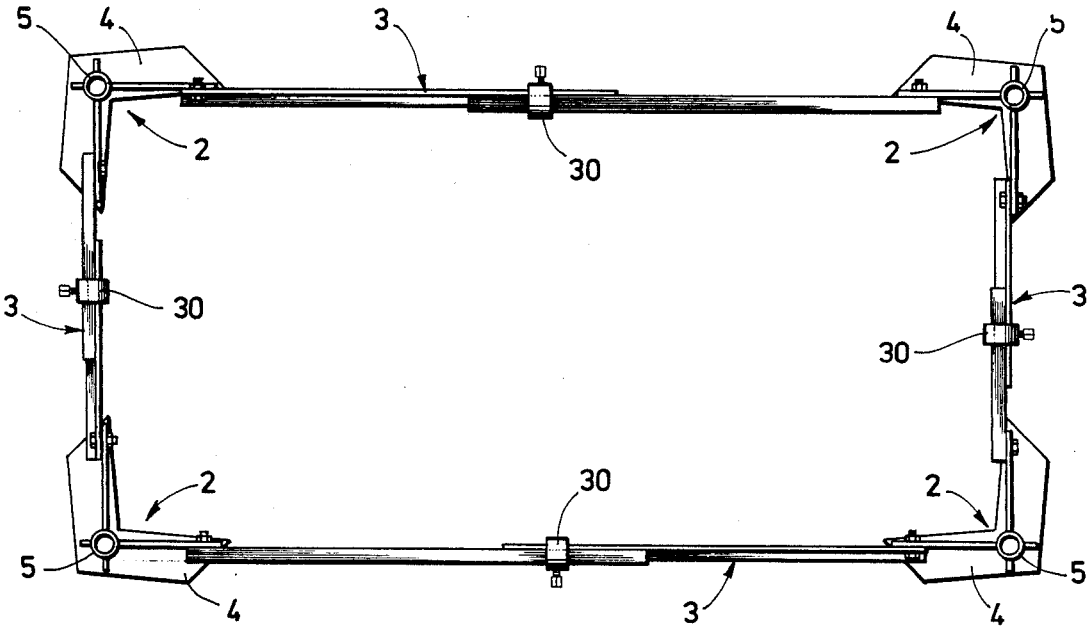
FIG. 9 is a plan view, somewhat fragmentary, to illustrate the positioning of certain support units and the connection thereof by appropriate tension elements.
Figure 10:
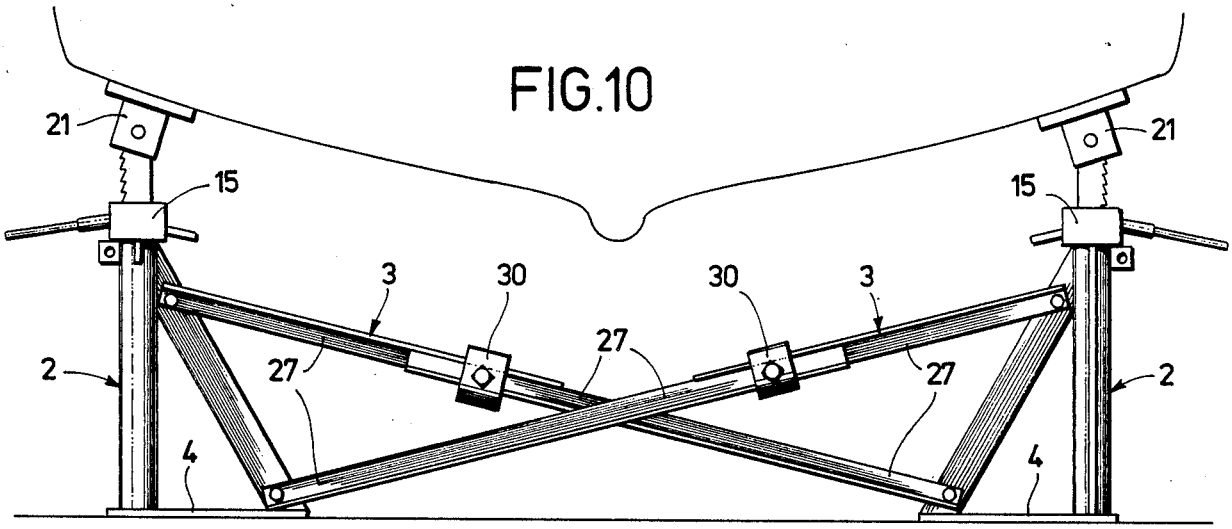
FIG. 10 is a view disclosing the interconnection of certain support units by the tension members to illustrate the flexibility thereof.

These parts are arranged in complementary overlapping positions for sliding engagement. A clamp unit designated 30 surrounds the overlapping ends of the parts 27, the clamp unit having a circular body such as a short section of pipe for example and designated 31. A set screw 32 in the body 31 by pressure on the parts 27 causes their frictional engagement to maintain the parts in a positions such as disclosed in FIGS. 1, 9 and 10, wherein the several support units are shown for supporting a boat or like object.

Other tension units of similar construction are availed of for the transverse connection of support units and are of substantially identical construction so as to effect the inter-connection and act to maintain the support units in their relationship to the boat or the like being supported above the support units.

Figure 11:
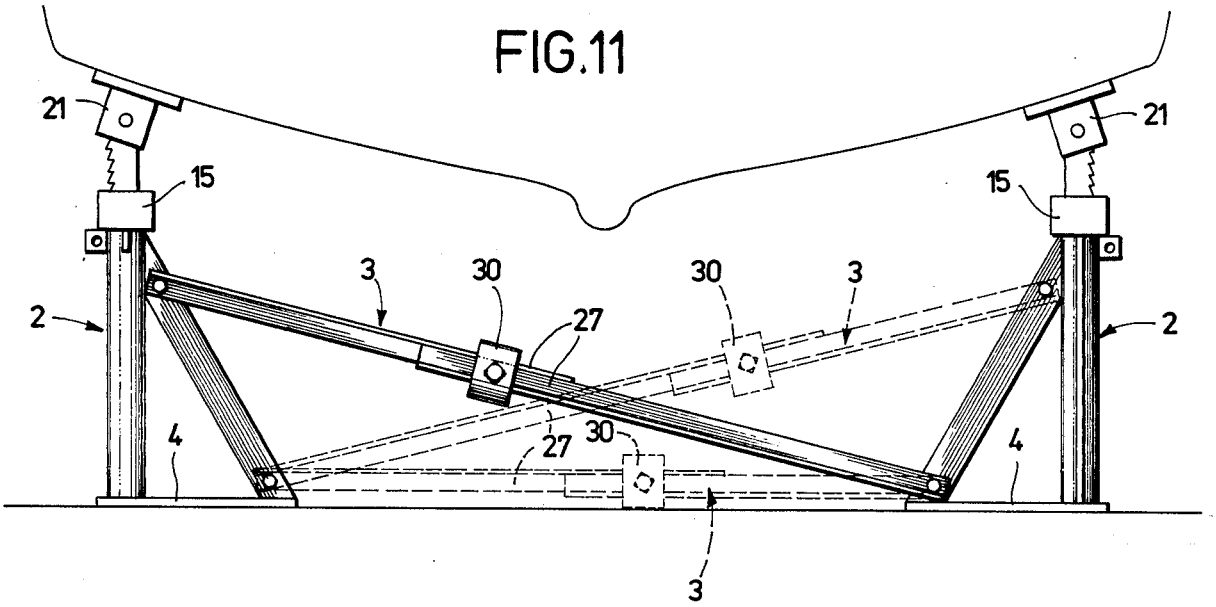
FIG. 11 is a view from the side of FIG. 9 to illustrate tension units as they are arranged in longitudinal direction.

FIG. 11 discloses a possible inter-connection arrangement of tension units such as 3, lending themselves to various combination arrangements by reason of the bolt hole positioning and the fact that the tension units are expandable or contractible as may be necessary for the conditions under which they are to be used.

I claim:

1. Boat cradle and storage means comprising a set of at least two spaced main support units of substantially identical construction, each including a base member to engage the surface above which a boat or the like is to be supported, a substantially vertical column extending upwardly from the base member, a pair of brace parts extending angularly and engaging the column and base member, said brace parts being positioned to facilitate nesting of like units with the columns of each in closely spaced relation with respect to one another and tension units connecting the support units to maintain the same in spaced relation, wherein the base member is chevron-shaped, comprising a pair of diverging wing-like portions, the column is fixed at its lower end at the juncture of the portions, the brace parts are fastened at their lower extremities to corresponding ends of the wing-like portions and at their upper ends to the upper end of the column, the column is fastened to the base member in a position spaced from the apex formed at the juncture of the wing-like portions, to facilitate nesting of a series of support means with the column of each in substantial alignment, and relatively close to one another.

2. Cradle and storage means as claimed in claim 1, wherein the main support unit includes an upwardly extending ram and head carried thereby with elements to effect adjustable movement with respect to the column.

3. Means as claimed in claim 2, wherein the adjustable movement is provided by ratchet and lever elements, facilitating movement of the ram and head by lifting action.

4. Means as claimed in claim 2, wherein the ram is actuated to move upwardly by ratchet and lever elements operable to be released to lower the ram.

5. Cradle and storage means as claimed in claim 4, wherein means confined within the column connected to the lower end of the ram and column to limit upward movement of the ram are provided.

6. Means as claimed in claim 1, wherein the base member is chevron-shaped, comprising a pair of diverging wing-like portions, the column is fixed at its lower end at the juncture of the portions, the brace parts are fastened at their lower extremities to corresponding ends of the wing-like portions and at their upper ends to the upper end of the column.

7. Means as claimed in claim 6, wherein the angle of the edges of the wing-like portions with respect to one another is about 100 degrees to provide stability to the support unit with the brace parts being at an angle with respect to one another, whereby the extremities of the brace parts where connected to the base are at the extremities of said wing-like portions.

8. Cradle and storage means as claimed in claim 1, wherein the brace parts are provided with bolt openings near their upper and lower ends and tabs including a bolt opening is fixed at the upper end of the column in alignment with and opposite each brace part to provide for connecting tension units thereto.

9. Cradle and storage means as claimed in claim 1, wherein two sets of main support units are arranged in longitudinal spaced apart positions, the main brace parts of transverse opposite units being arranged in transverse alignment and certain brace parts of longitudinally spaced units likewise being arranged in alignment, brace ears on each of the units being arranged for aligned positioning, and tension units connecting aligned transversely spaced brace parts and other tension units connecting longitudinally spaced units.

10. Means as claimed in claim 9, wherein the tension units comprise slideably engaged parts with clamp means to fix such parts in position to prevent sliding after adjustment, with respect to one another, each unit being removably connected to its respective support unit.

11. Means as claimed in claim 9, wherein the tension units comprise slideably engaged parts with clamp means to fix such parts in position to prevent sliding after adjustment, with respect to one another, each unit being removably connected to its respective support unit, the clamp means including a ring-like body surrounding the slideably engaged parts in the area where they are engaged, and a set screw extending through the ring-body to force one of the engaged parts into frictional engagement with the other part.

12. Means as claimed in claim 9, wherein an intermediate support unit is positioned between each pair of main support units and tension units extend from each main unit to an intermediate unit.

13. Cradle and storage means as claimed in claim 1, wherein two sets of main support units are arranged in longitudinal spaced apart positions, the main brace parts of transversely opposite units being arranged in transverse alignment, and certain brace parts of longitudinally spaced units likewise being arranged in alignment, brace ears on each of the units being arranged for aligned positioning and tension units connecting aligned transversely spaced brace parts and other tension units connecting longitudinally spaced units by engaging a brace ear of one unit with a brace part of the longitudinally spaced unit.

14. Means as claimed in claim 13, wherein the tension units are adjustable lengthwise, are connected to longitudinally spaced support units at the lower end of one brace part and to an aligned ear of an adjacent unit, the corresponding opposite support units having tension units connecting an ear of one unit with an aligned brace part of the adjacent unit, said tension units being positioned to be connected in oppositely angled relation.

* * * * *